US005622487A

United States Patent [19]

Fukuhara et al.

[11] Patent Number: 5,622,487

[45] Date of Patent: Apr. 22, 1997

[54] SCROLL COMPRESSOR HAVING A SEPARATE STATIONARY WRAP ELEMENT SECURED TO A FRAME

[75] Inventors: Hiroyuki Fukuhara; Sadayuki Yamada, both of Ōtsu; Shigeru Muramatsu, Kusatsu, all of Japan

[73] Assignee: Matsushita Electric Industrial Co., Ltd., Osaka-fu, Japan

[21] Appl. No.: 477,626

[22] Filed: Jun. 7, 1995

Related U.S. Application Data

[62] Division of Ser. No. 334,326, Nov. 2, 1994, abandoned.

[30] Foreign Application Priority Data

Nov. 2, 1993 [JP] Japan ..... 5-274115

[51] Int. Cl.[6] ..... F04C 18/04; F04C 29/04

[52] U.S. Cl. ..... 418/55.2; 418/55.5; 418/57; 418/83; 418/179

[58] Field of Search ..... 418/55.2, 83, 179; 29/888, 22

[56] References Cited

U.S. PATENT DOCUMENTS

| | | | |
|---|---|---|---|
| 3,924,977 | 12/1975 | McCullough | 418/57 |
| 4,995,789 | 2/1991 | Fujio | 417/360 |
| 5,044,904 | 9/1991 | Richardson, Jr. | 418/55.2 |
| 5,106,279 | 4/1992 | Richardson, Jr. | 418/55.2 |
| 5,277,562 | 1/1994 | Fukuhara et al. | 418/55.2 |

FOREIGN PATENT DOCUMENTS

| | | | |
|---|---|---|---|
| 59-34494 | 2/1984 | Japan | 418/55.2 |
| 59-79089 | 5/1984 | Japan | 418/55.2 |
| 63-272981 | 11/1988 | Japan | 418/55.2 |
| 2157487 | 6/1990 | Japan | 418/55.2 |

*Primary Examiner*—John J. Vrablik
*Attorney, Agent, or Firm*—Wenderoth, Lind & Ponack

[57] ABSTRACT

A scroll compressor has a compression mechanism accommodated in a closed container and comprising a stationary scroll and an orbiting scroll. The stationary scroll includes a frame and a separate wrap element secured to the frame or otherwise movable relative to the frame. The orbiting scroll has a wrap element allowed to undergo circular translation with respect to the wrap element of the stationary scroll to compress gas. The wrap element of the stationary scroll is made of a readily machinable abrasion-resistant material to reduce the manufacturing cost of the scroll compressor.

8 Claims, 5 Drawing Sheets

SCROLL COMPRESSOR HAVING A SEPARATE STATIONARY WRAP ELEMENT SECURED TO A FRAME

This is a divisional application of Ser. No. 08/334,326, filed Nov. 2, 1994, abandoned.

BACKGROUND OF THE INVENTION

1. Field of the Invention

The present invention relates to a scroll compressor generally utilizable in air conditioning equipment for industrial use and home use.

2. Description of Related Art

The motor-driven compressor now in use in refrigerating systems is available in two types; that in which reciprocating pistons are employed and that in which rotary pistons are employed. Both are generally employed in air conditioning systems for industrial and home use and the use thereof is increasing as they have their own advantages and satisfactory performances. Recently, a new version of compressor known as a scroll compressor has gained a wide application because of its low-noise and low-vibration features.

FIG. 5 is a vertical sectional view showing an example of a conventional scroll compressor. As shown therein, a closed container 1 accommodates, in an upper portion thereof, a compression mechanism 2 comprising a stationary scroll 2*a* and an orbiting scroll 2*b* which is to undergo circular translation with a variable circular orbiting radius; a thrust bearing 3 for supporting the orbiting scroll 2*b*; and a bearing member 4 for supporting the thrust bearing 3. The orbiting scroll 2*b* has a shaft 2*c* inserted into an eccentric bearing 6 received in a hole 5*b*, that is defined at an end 5*a* of a crankshaft 5, so that the crankshaft 5 can drive the orbiting scroll 2*b* in one direction. An electric motor 7 includes a rotor 7*a* mounted on the crankshaft 5 for rotation together therewith, and a stator 7*b* fixed to the closed container 1 by means of shrinkage fit. The rotor 7*a* and the stator 7*b* are disposed below the bearing member 4 within the closed container 1. The crankshaft 5 is supported by a main bearing 8 of the bearing member 4 and an auxiliary bearing 23 thereof.

An oil reservoir 10 for accommodating a quantity of lubricating oil 9 is defined at the bottom of the closed container 1. A gas-sucking pipe 11 is provided on a side of the closed container 1. A gas pressure on the suction side acts on a lower portion of the closed container 1 below a spacer 22, whereas a gas pressure on the compression side acts on an upper portion of the closed container 1 above the spacer 22. The bearing member 4 has an oil exhaust port 12 defined therein for exhausting the lubricating oil 9 which has lubricated and cooled the main bearing 8, the auxiliary bearing 23, the eccentric bearing 6, and the thrust bearing 3. The crankshaft 5 has a through-hole 13 defined therein for supplying the lubricating oil 9 to each bearing, namely, the main bearing 8, the auxiliary bearing 23, the eccentric bearing 6, and the thrust bearing 3.

An oil guide 14 is fixed to the lower end of the crankshaft 5 by means of interference fit or by shrinkage fit so as to suck up the lubricating oil 9 from the oil reservoir 10. The closed container 1 further comprises an exhaust chamber 15 defined therein above the stationary scroll 2*a* and an exhaust pipe 16 for discharging compressed gas to the outside of the closed container 1. The stationary scroll 2*a* and the bearing member 4 are fastened to each other by bolts with the spacer 22 sandwiched therebetween. The stationary scroll 2*a* is of one-piece construction having a frame for fixing the stationary scroll 2*a* to the bearing member 4, and a wrap element integrally formed with the frame. The orbiting scroll 2*b* also has a wrap element integrally formed therewith. Each of the wrap elements has a spiral or involute shape required to compress gas.

The spacer 22 has its outer periphery fixed to the closed container 1 by welding, thus partitioning the interior of the closed container 1 into a lower portion on which a gas pressure on the suction side acts and an upper portion on which a gas pressure on the compression side acts.

The closed container 1 further comprises a check valve 19 for preventing a reverse rotation of the orbiting scroll 2*b* when the scroll compressor is stopped; a check valve guide 24 for restricting an axial movement of the check valve 19; an Oldham ring 20 for preventing the orbiting scroll 2*b* from rotating about its own axis but allowing it to undergo circular translation with respect to the stationary scroll 2*a*; and a suction port 21, defined in the bearing member 4, for supplying the compression mechanism 2 with low-pressure gas.

The operation of the compression mechanism 2 having the above-described construction will now be described below. The low-pressure gas is returned into the closed container 1 from the gas-sucking pipe 11 and draw into the compression mechanism 2. The orbiting scroll 2*b* undergoes circular translation with respect to the stationary scroll 2*a*, thus allowing the compression mechanism 2 to compress the gas drawn thereinto. Consequently, the pressure of the gas rises and enters the exhaust chamber 15. Then, the gas is discharged to the outside of the closed container 1 from the exhaust pipe 16. Low-pressure gas is introduced into the closed container 1 again and circulated therein, thereby completing a single cycle of compression well known to those skilled in the art.

On the other hand, the lubricating oil 9 sucked up by the oil guide 14 moves upward through the through-hole 13 in the crankshaft 5 to lubricate and cool the auxiliary bearing 23, the eccentric bearing 6, the thrust bearing 3, and the main bearing 8. Thereafter, the lubricating oil 9 is exhausted from the oil exhaust port 12 to an upper portion of the stator 7*b* and, then, returns to the oil reservoir 10 via a cut-out portion 18 of the stator 7*b*, thereby completing a lubricating cycle.

In order to manufacture a scroll compressor that is highly reliable, highly efficient, and inexpensive, it is important not only to use light component parts, but also select configurations of the component parts appropriate to forces which would act thereon during the use of the scroll compressor. Also, in order to manufacture the scroll compressor having a high efficiency, it is important to configure the wrap elements with high precision. In this respect, the number of processes required to manufacture a desired involute configuration affects the cost of the scroll compressor. Thus, it is necessary to process the wrap elements having a highly precise involute configuration with a high efficiency. In processing the wrap elements, particularly the wrap element of the stationary scroll 2*a*, the material thereof has a great influence on the process efficiency and process precision of the scroll compressor. Thus, it can be safely said that whether or not a scroll compressor which is inexpensive and highly efficient can be manufactured depends on the selection of the material of the wrap element of the stationary scroll 2*a*. A material which can be readily processed into the wrap element is costly. Also, in applications where readily processable eutectic graphite cast iron is used for the wrap element, it is difficult to configure the raw material into a desired configuration and, hence, a quantity of raw material more than necessary is required. Thus, the manufacture of an inexpensive scroll compressor cannot be expected.

In the case of the conventional scroll compressor, the stationary scroll comprises the frame for fixing the stationary scroll to the bearing member and to the spacer; and the wrap element having an involute shape required to compress gas. It is to be noted that the frame and the wrap element are integrally formed with each other. Mostly, the stationary scroll is made of cast iron. Formation of the stationary scroll having a complicated configuration causes the cost of the scroll compressor to be high. The selection of an inexpensive casting method necessitates preparation of a thick material, which leads to the formation of a thick stationary scroll. Consequently, the manufacturing cost becomes high due to the weight increase of the stationary scroll, the rise of a material cost, and the increase in machining allowance.

In the case of the conventional scroll compressor, the bearing member supporting the orbiting scroll via the thrust bearing, the spacer, and the stationary scroll are fastened to each other by means of bolts. During the operation of the compressor, force is applied to the stationary scroll and the orbiting scroll in the direction in which both scrolls move away from each other, due to the influence of compressed gas. Consequently, the compressed gas leaks, lowering the efficiency of the scroll compressor. In order to prevent this, a tip seal is provided at the leading end of each scroll. As a result, the manufacturing cost rises owing to the rise of material cost caused by the increase of the number of parts or owing to the increase of portions to be processed and assembled. Thus, the conventional art is incapable of manufacturing an inexpensive scroll compressor.

In addition, the compressed gas having a high temperature and pressure is exhausted to the periphery of the stationary scroll. Thus, the stationary scroll conducts heat from the compressed high-temperature gas, thus heating low-temperature gas introduced into the closed container and gas being compressed by the compression mechanism. Consequently, the efficiency of the scroll compressor is lowered, resulting in a reduction in volumetric efficiency.

The compressed gas having a high pressure flows backward toward the compressed gas having a low pressure when the compressor is stopped. Therefore, a check valve is required to minimize the period of time in which the orbiting scroll and the crankshaft rotate in reverse. It is important to shorten the period of time in which the orbiting scroll and the crankshaft rotate in reverse, so that the scroll compressor is reliable. To this end, it is necessary to dispose the check valve close to the compression mechanism so as to reduce the volume of high-pressure gas flowing backward. In the conventional compressor, the check valve is disposed immediately above the exhaust port of the stationary scroll. Thus, the check valve guide is required to prevent the check valve from being dislocated.

SUMMARY OF THE INVENTION

The present invention has been developed with a view to substantially solving the above described disadvantages and has for its essential objective to provide an inexpensive and reliable scroll compressor having a stationary scroll that is comprised of a frame and a separate wrap element made of a readily machinable material.

In accomplishing the above and other objectives, the scroll compressor according to the present invention comprises a closed container and a compression mechanism accommodated in the closed container and comprising a stationary scroll and an orbiting scroll. The stationary scroll comprises a frame and a separate wrap element secured to the frame. The orbiting scroll has a wrap element allowed to undergo circular translation with respect to the wrap element of the stationary scroll.

The scroll compressor also comprises a thrust bearing for supporting the orbiting scroll; a crankshaft having an eccentric bearing in engagement with a shaft of the orbiting scroll to drive the orbiting scroll; an electric motor comprising a rotor mounted on the crankshaft and a stator mounted inside the closed container; and an oil reservoir for reserving lubricating oil inside the closed container.

The wrap element of the stationary scroll has a spiral or involute shape and is preferably made of a readily machinable material.

The frame and the wrap element of the stationary scroll may be fixed to each other by means of bolts, shrinkage fit or the like.

Advantageously, the material of the frame differs from that of the wrap element of the stationary scroll. The frame may be made of steel, while the wrap element of the stationary scroll may be made of cast iron.

Preferably, the wrap element of the stationary scroll is made of eutectic graphite cast iron, while the frame is made of grey cast iron.

Advantageously, an insulation material is interposed between the frame and the wrap element of the stationary scroll.

Conveniently, a check valve is interposed between the frame and the wrap element of the stationary scroll so as to stop reverse rotation of the orbiting scroll and the crankshaft which occurs immediately after the compressor is stopped. This construction reduces the quantity of high pressure gas flowing backward. The provision of the check valve reduces the number of parts to be installed in the periphery of a check valve guide, thus reducing the manufacturing cost.

Alternatively, the wrap element of the stationary scroll may be axially slidably movable relative to the frame. In this case, the wrap element of the stationary scroll is pressed against the orbiting scroll by making use of high-pressure gas applied to the upper surface of the wrap element.

According to the technical means of the present invention, it is possible to select different materials suitable for the functional characteristics of the wrap element and the frame of the stationary scroll. That is, the wrap element of the stationary scroll may be made of eutectic graphite cast iron which can be processed with high precision, while the frame may be made of steel or grey cast iron having a high strength. Thus, an inexpensive scroll compressor can be provided.

Further, the separated structure of the frame and the wrap element prevents the stationary scroll from conducting heat of compressed gas, having a high pressure and temperature, present in the periphery of the stationary scroll, thus increasing the efficiency of the scroll compressor.

The heat insulation material interposed between the frame and the wrap element prevents the compressed gas from being heated, thus further increasing the efficiency of the scroll compressor.

In addition, the structure in which the wrap element of the stationary scroll is axially slidably movable relative to the frame also contributes to the efficient scroll compressor.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 5:
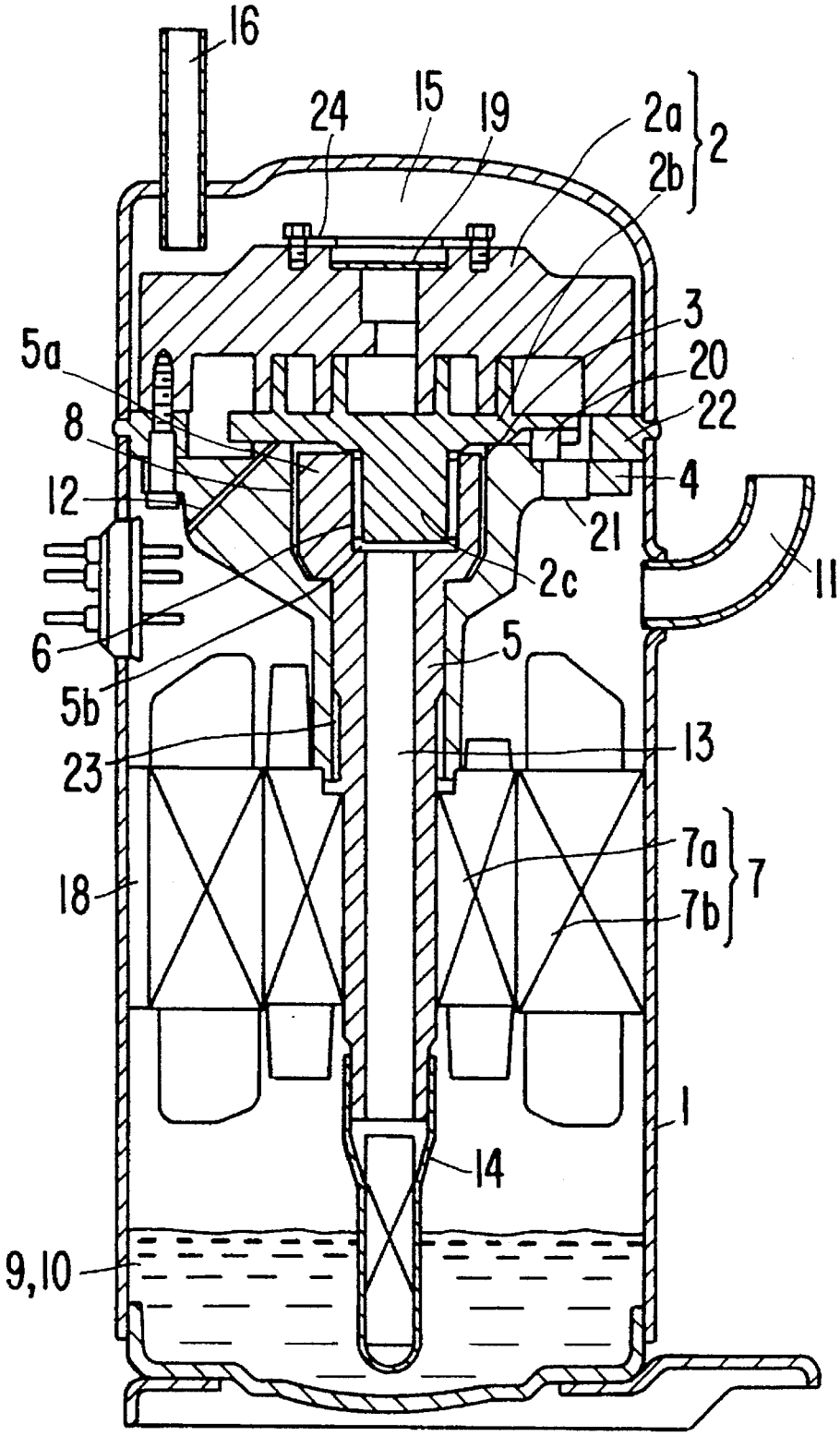
FIG. 5 PRIOR ART
FIG. 5 is a longitudinal sectional view of a conventional scroll compressor.

Before the description of the present invention proceeds, it is to be noted that a scroll compressor according to a first embodiment of the present invention is almost the same as that of the conventional scroll compressor shown in FIG. 5 except for the details of a stationary scroll.

Figure 1A:
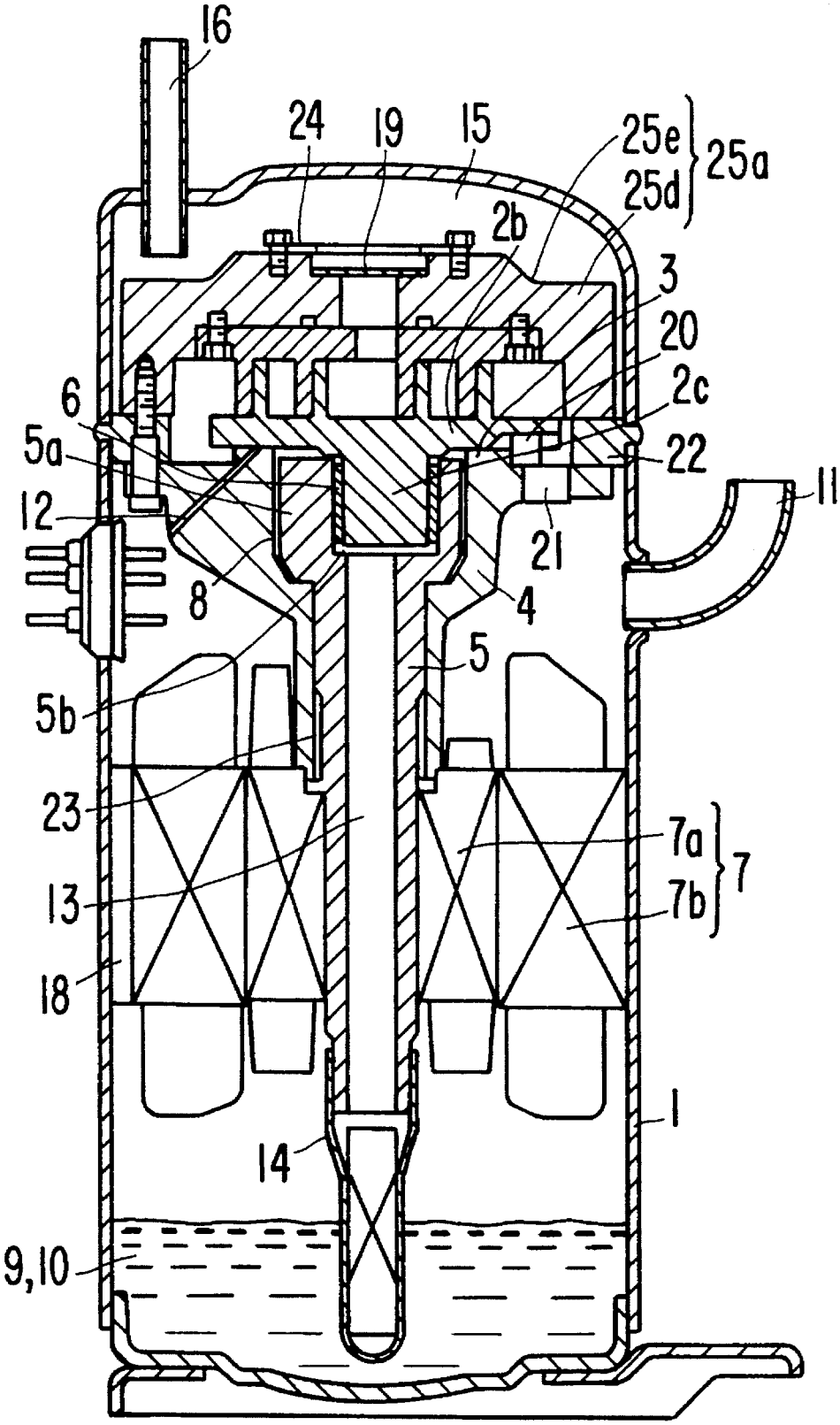
FIGS. 1A and 1B are longitudinal sectional views of a scroll compressor according to a first embodiment of the present invention.

Referring now to FIG. 1A, a closed container 1 accommodates, in an upper portion thereof, a compression mechanism 2 comprising a stationary scroll 25*a* and an orbiting scroll 2*b* which is to undergo circular translation with a variable circular orbiting radius; a thrust bearing 3 for supporting the orbiting scroll 2*b*; and a bearing member 4 for supporting the thrust bearing 3. The orbiting scroll 2*b* has a shaft 2*c* inserted into an eccentric bearing 6 within a hole 5*b* defined at an end 5*a* of a crankshaft 5 so that the orbiting scroll 2*b* can be driven in one direction by the crankshaft 5.

An electric motor 7 has a rotor 7*a* mounted on the crankshaft 5 for rotation together therewith and a stator 7*b* fixed to the closed container 1 by means of shrinkage fit, both of the rotor 7*a* and the stator 7*b* being disposed below the bearing member 4. The crankshaft 5 is supported by a main bearing 8 of the bearing member 4 and an auxiliary bearing 23 thereof. An oil reservoir 10 for reserving lubricating oil 9 is defined in the bottom of the closed container 1. A gas-sucking pipe 11 is provided on a side of the closed container 1. A gas pressure on the suction side acts on the portion of the closed container 1 below a spacer 22, whereas a gas pressure on the compression side acts on the portion of the closed container 1 above the spacer 22.

The bearing member 4 has an oil exhaust port 12 defined therein for exhausting the lubricating oil 9 which has been used to lubricate and cool the main bearing 8, the auxiliary bearing 23, the eccentric bearing 6, and the thrust bearing 3. The crankshaft 5 has a through-hole 13 defined therein for supplying the lubricating oil 9 to each bearing, namely, the main bearing 8, the auxiliary bearing 23, the eccentric bearing 6, and the thrust bearing 3. An oil guide 14 is fixed to the lower end of the crankshaft 5 by means of interference fit or by shrinkage fit so as to suck up the lubricating oil 9 from the oil reservoir 10.

The closed container 1 further comprises an exhaust chamber 15 defined therein above the stationary scroll 25*a* and an exhaust pipe 16 for discharging compressed gas to the outside of the closed container 1. The stationary scroll 25*a* and the bearing member 4 are fastened to each other by bolts with the spacer 22 sandwiched therebetween.

The stationary scroll 25*a* comprises a frame 25*d* for fixing the stationary scroll 25*a* to the bearing member 4, and a wrap element 25*e* having a spiral or involute shape required to compress gas. The wrap element 25*e* is separate from the frame 25*d*, but is rigidly secured thereto, unlike the conventional scroll compressor.

The orbiting scroll 2*b* has a wrap element having a spiral or involute shape similar to that of the wrap element 25*e* of the stationary scroll 25*a*.

The spacer 22 has its outer periphery fixed to the closed container 1 by welding, thus partitioning from each other a lower portion on which a gas pressure on the suction side acts and an upper portion on which a gas pressure on the compression side acts.

The closed container 1 further comprises a check valve 19 for preventing reverse rotation of the orbiting scroll 2*b* when the scroll compressor is stopped; a check valve guide 24 for restricting an axial movement of the check valve 19; an Oldham ring 20 for restricting the movement of the orbiting scroll 2*b* with respect to the stationary scroll 25*a*; and a suction port 21, defined in the bearing member 4, for supplying the compression mechanism 2 with low-pressure gas. The wrap element of the orbiting scroll 2*b* and the wrap element 25*e* of the stationary scroll 25*a* are maintained in fixed angular relationship to each other by the Oldham ring 20, which however allows the former to undergo circular translation with respect to the latter.

The operation of the compression mechanism 2 having the above-described construction will now be described below. The low-pressure gas is returned into the closed container 1 from the gas-sucking pipe 11 and drawn into the compression mechanism 2. The orbiting scroll 2*b* undergoes circular translation with respect to the stationary scroll 2*a*, thus allowing the compression mechanism 2 to compress the gas drawn thereinto. Consequently, the pressure of the gas rises and enters the exhaust chamber 15. Then, the gas is discharged to the outside of the closed container 1 from the exhaust pipe 16. Low-pressure gas is introduced into the closed container 1 again and circulated therein, thereby completing a known single compression cycle.

The frame 25*d* and the wrap element 25*e* of the stationary scroll 25*a* are fixed to each other by shrinkage or expansion fit or fastened to each other by means of bolts via a sealing member such as an O-ring. The wrap element 25*e* is made of a readily machinable abrasion-resistant material such as eutectic graphite cast iron, aluminum alloy or the like.

Such a material can be readily processed and configured into the wrap element 25*e* with high precision at a low cost. Because the wrap element 25*e* is separate from the frame 25*d*, a small quantity of light-weight material is sufficient for the wrap element 25*e*. Thus, although the material of the wrap element 25*e* is expensive, the rise of the material cost is slight. The frame 25*d* can readily be formed into a desired configuration if steel or the like is employed and, therefore, a strong, light-weight and inexpensive stationary scroll can be manufactured.

As discussed hereinabove, the light and inexpensive stationary scroll can be easily manufactured by employing a material suitable for the functional characteristic of each of the wrap element 25*e* and the frame 25*d* separate from the wrap element 25*e*. Also, a light-weight, inexpensive and reliable frame 25*d* having a required configuration can be made upon selection of an appropriate manufacturing method. A material such as eutectic graphite cast iron, aluminum alloy or the like can be readily and precisely processed into the efficient and inexpensive wrap element 25*e* having an involute shape.

In general, not only is any easily machinable material more expensive for a given quantity than any other material, but also the method that can be used to machine the easily machinable material is limited. In addition, if easily machinable eutectic graphite cast iron is used for the wrap element 25*e*, the freedom of shaping it is very limited, requiring much machining allowance. Because of this, the method required to complete manufacture requires an increased number of process steps. However, the easily machinable material, namely, an expensive material, is used only for the small-sized wrap element 25*e*. As such, although the easily machinable material is selected to make the wrap element 25*e*, the total cost for manufacturing the wrap element 25*e* is lower than that required to make it with the use of an inexpensive material in view of the machinability.

Figure 1B:
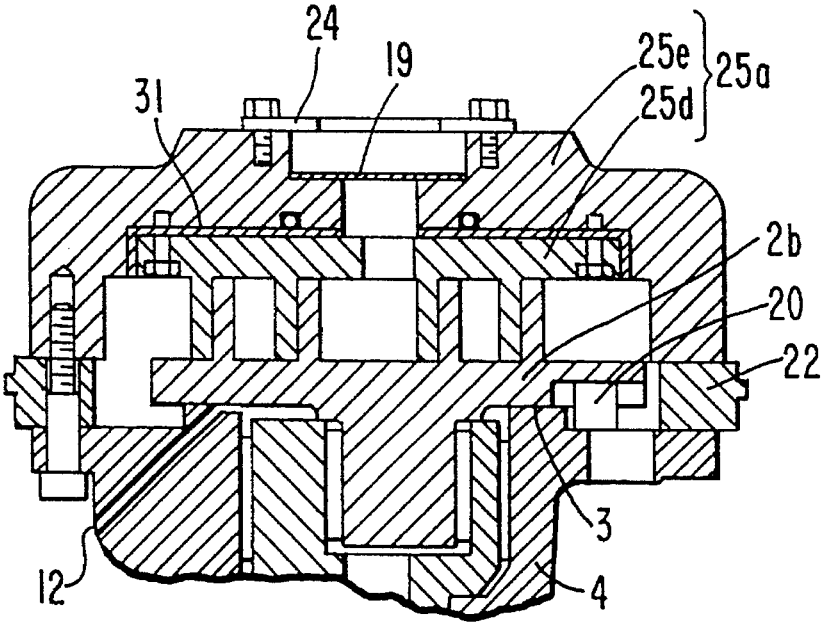

The frame 25*d* made of steel or grey cast iron and the wrap element 25*e* made of cast iron or eutectic graphite cast iron have the above-described advantage. As shown in FIG. 1B, a heat insulation material 31 sandwiched between the frame 25*d* and the wrap element 25*e* prevents the stationary scroll 25*a* from conducting heat of compressed gas, having a high pressure and temperature, present in the periphery of the stationary scroll 25*a*. That is, the heat insulation material 31 prevents the gas introduced into the closed container 1 and the gas being compressed by the compression mechanism 2 from being heated, thus preventing the efficiency of the scroll compressor from being lowered.

Figure 2:
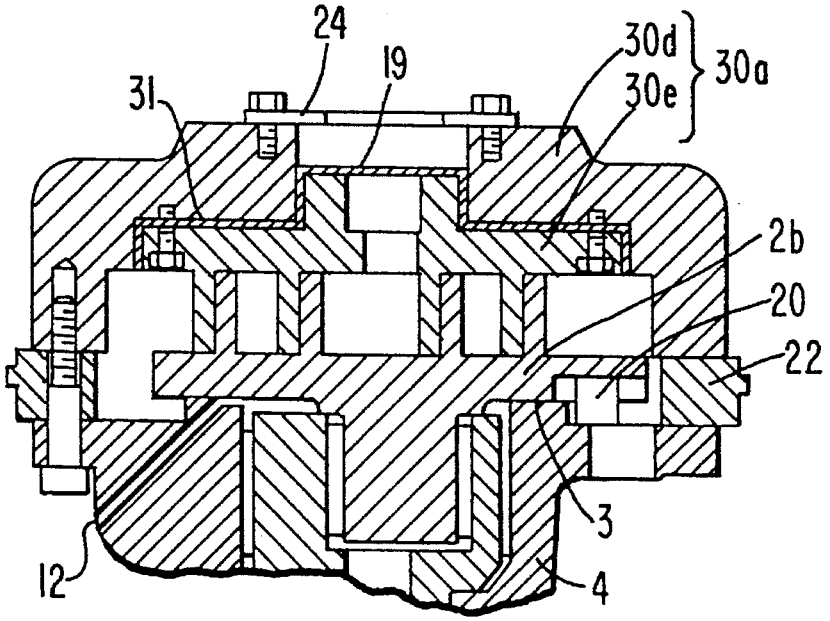
FIG. 2 is a longitudinal sectional view of a stationary scroll and elements disposed in the vicinity thereof according to a second embodiment of the present invention.

A scroll compressor according to a second embodiment of the present invention will now be described below with reference to FIG. 2. The scroll compressor according to the second embodiment is substantially similar to that according to the first embodiment in construction and hence in operation. Thus, the description of the entire construction of the scroll compressor according to the second embodiment is omitted herein and only the construction thereof that differs from that according to the first embodiment will be described below.

A stationary scroll 30*a* comprises a frame 30*d* for fixing a stationary scroll 30*a* to the bearing member 4*a*, and a wrap element 30*e* having a spiral or involute shape required to compress gas. The wrap element 30*e* and the frame 30*d* are fastened to each other by means of bolts, with a heat insulation material 31 interposed therebetween.

The heat insulation material 31 prevents the gas introduced into the closed container and gas being compressed by the compression mechanism from being heated, thus contributing to the efficient scroll compressor.

Figure 3A:
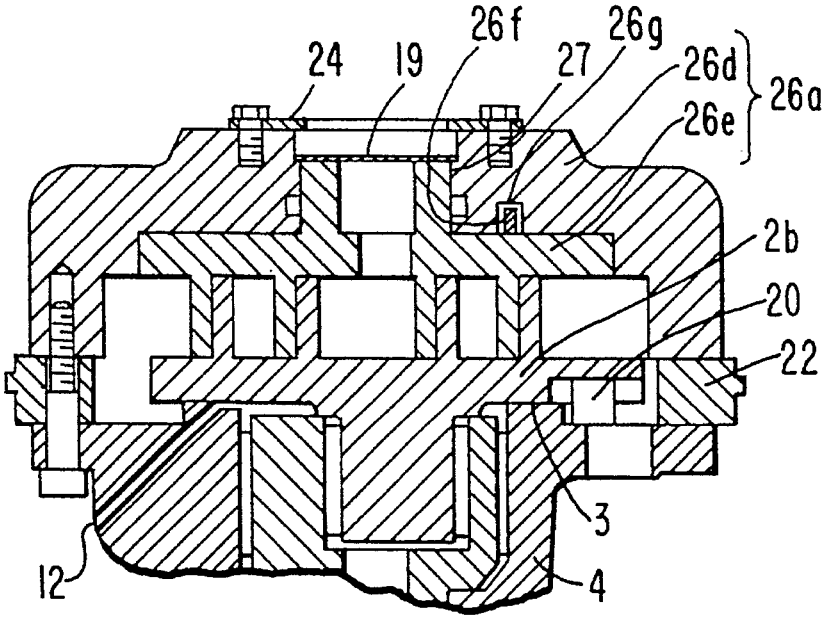
FIGS. 3A and 3B are views similar to FIG. 2, but according to a third embodiment of the present invention.
Figure 3B:
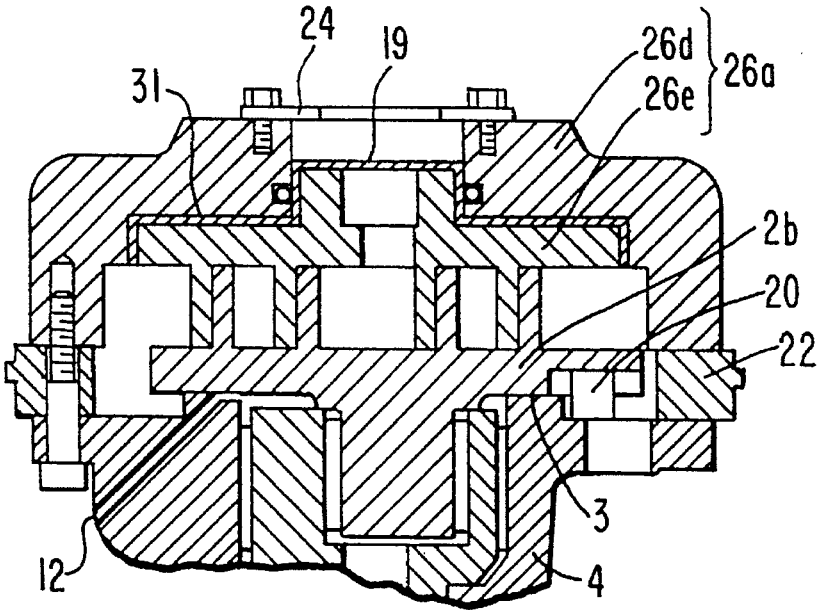

A scroll compressor according to a third embodiment of the present invention will now be described below with reference to FIGS. 3A and 3B. The scroll compressor according to the third embodiment is substantially similar to that according to the first embodiment in construction and hence in operation except for the stationary scroll and other elements disposed in the periphery thereof. Thus, the description of the entire construction of the scroll compressor according to the third embodiment is omitted herein, and only the construction thereof that differs from that according to the first embodiment will be described below.

A stationary scroll 26*a* comprises a frame 26*d* and a wrap element 26*e* freely movable relative to the frame 26*d* in a direction axially thereof. To this end, the wrap element 26*e* has an insert 26*f* slidably inserted into an opening 26*g* defined in the frame 26*d*.

In operation, the wrap element 26*e* is pressed against an orbiting scroll 2*b* by making use of high-pressure gas applied to the upper surface of the wrap element 26*e* or by the resiliency of a spring (not shown) exceeding the pressure of the compressed gas.

This construction eliminates a gap between the orbiting scroll 2*b* and the stationary scroll 26*a* in the axial direction thereof, thus preventing gas leakage. Because of this, the scroll compressor according to the third embodiment of the present invention is highly efficient.

As is the case with the first embodiment of the present invention, the light and inexpensive stationary scroll can be easily manufactured by employing a material suitable for the functional characteristic of each of the wrap element 26*e* and the frame 26*d* separate from the wrap element 26*e*. As shown in FIG. 3B, heat insulation material 31 may be sandwiched between the frame 26*d* and the wrap element 26*e* to prevent the stationary scroll 26*a* from conducting heat of the compressed gas, having a high pressure and temperature, present in the periphery of the stationary scroll 26*a*. That is, the use of the heat insulation material 31 can effectively prevent the gas introduced into the closed container and the gas being compressed by the compression mechanism from being heated, thus contributing to the efficient scroll compressor.

Figure 4:
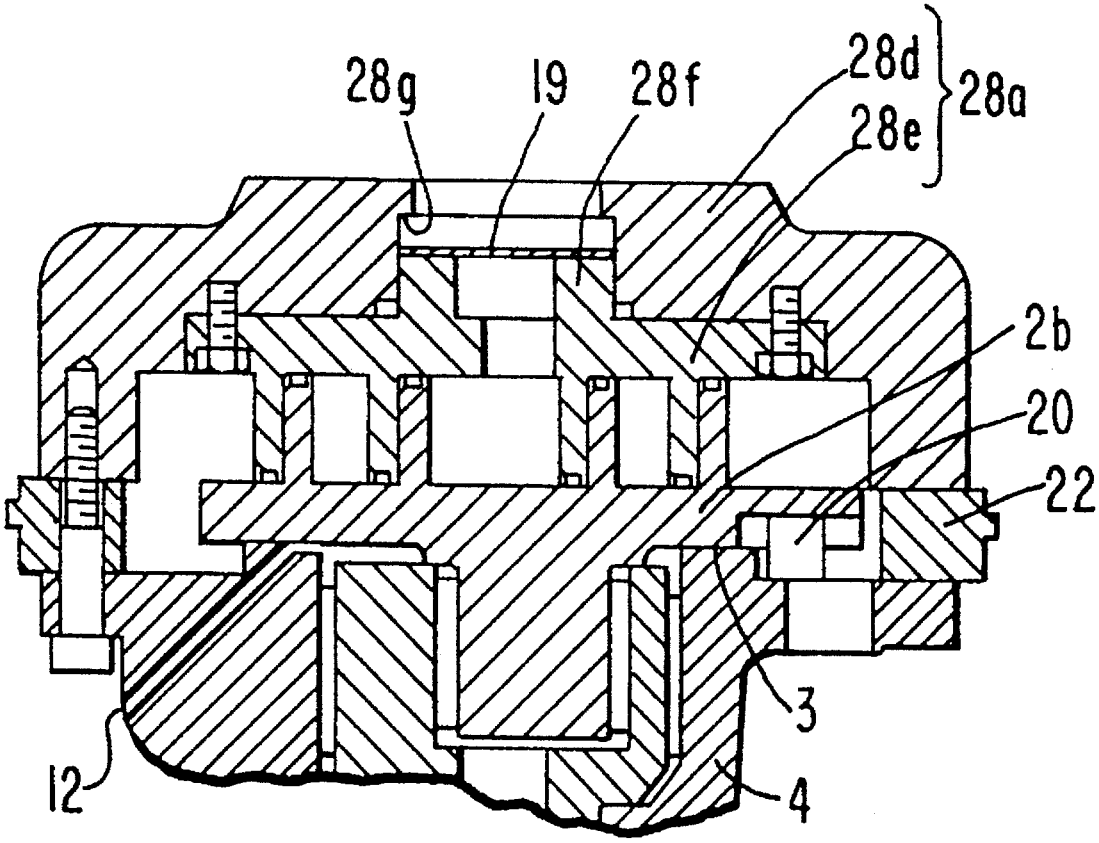
FIG. 4 is a view similar to FIG. 2, but according to a fourth embodiment of the present invention.

A scroll compressor according to a fourth embodiment of the present invention will now be described below with reference to FIG. 4. The scroll compressor according to the fourth embodiment is substantially similar to that according to the first embodiment in construction and hence in operation except for a stationary scroll and other elements disposed in the periphery thereof. Thus, the description of the entire construction of the scroll compressor according to the fourth embodiment is omitted herein, and only the construction thereof that differs from that according to the first embodiment will be described below.

A stationary scroll 28*a* comprises a frame 28*d* for fixing the stationary scroll 28*a* to the bearing member 4 and a wrap element 28*e* rigidly secured to the frame 28*d* and having a spiral or involute shape required to compress gas. The wrap element 28*e* has an insert 28*f* inserted into an opening defined in the frame 28*d*. A sealing member such as an O-ring is interposed between the frame 28*d* and the wrap element 28*e*. A check valve 19 is operatively inserted in a recess 28*g* defined in the frame 28*d* at the center thereof, and the movement of the check valve 19 in a direction axially of the stationary scroll 28*a* is restricted by the frame 28*d* and the insert 28*f* of the wrap element 28*e*. The check valve 19 stops reverse rotation of the orbiting scroll 2*b* and the crankshaft which occurs immediately after the compressor is stopped.

The above construction minimizes the period of time in which the orbiting scroll 2*b* and the crankshaft rotate in reverse due to the backward flow of the compressed gas which occurs immediately after the compressor is stopped, thus improving the reliability of the compressor. Further, this construction eliminates the necessity of the check valve guide for restricting the movement of the check valve and check valve-fixing bolts, thus reducing the material cost and manufacturing cost and providing a highly reliable and inexpensive scroll compressor.

As is apparent from the foregoing description, the stationary scroll which is the main component of the compression mechanism comprises the frame for fixing the stationary scroll to the other elements, and the separate wrap element for compressing gas. The wrap element is made of a machinable material. Thus, the efficient high-accuracy scroll compressor of the present invention can be manufactured at a low cost without wasting the raw material.

Further, because the wrap element and the frame are separate from each other, heat transfer therebetween is small. In addition, the heat insulation material sandwiched between the frame and the wrap element prevents the stationary scroll from conducting heat of compressed gas, thus increasing the efficiency of the scroll compressor.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor comprising:

a closed container;

a compression mechanism accommodated in said closed container and comprising a stationary scroll and an orbiting scroll, said stationary scroll comprising a frame and a separate wrap element secured to said frame, said orbiting scroll having a shaft and a wrap element allowed to undergo circular translation with respect to said wrap element of said stationary scroll;

a thrust bearing supporting said orbiting scroll;

a crankshaft having an eccentric bearing in engagement with said shaft of said orbiting scroll, said crankshaft being operably coupled to said orbiting scroll;

an electric motor comprising a rotor mounted on said crankshaft and a stator mounted inside said closed container;

an oil reservoir defined inside said closed container; and an insulation material interposed between said frame and said wrap element of said stationary scroll.

2. The scroll compressor according to claim 1, wherein said wrap element of said stationary scroll is made of a readily machinable material.

3. The scroll compressor according to claim 1, wherein said wrap element of said stationary scroll is made of eutectic graphite cast iron.

4. The scroll compressor according to claim 1, further comprising a check valve interposed between said frame and said wrap element of said stationary scroll.

5. The scroll compressor according to claim 1, further comprising a check valve mounted to said frame of said stationary scroll.

6. The scroll compressor according to claim 1, wherein said wrap element of said stationary scroll is fixed to said frame of said stationary scroll.

7. The scroll compressor according to claim 1, wherein said wrap element of said stationary scroll is axially movably mounted to said frame of said stationary scroll.

8. The scroll compressor according to claim 7, wherein one of said frame and said wrap element of said stationary scroll has an opening, and the other of said frame and said wrap element of said stationary scroll has an insert slidably inserted in said opening.

* * * * *